US005288253A

United States Patent [19]

Urdshals et al.

[11] Patent Number: 5,288,253

[45] Date of Patent: Feb. 22, 1994

[54] SINGLE POINT MOORING SYSTEM EMPLOYING A SUBMERGED BUOY AND A VESSEL MOUNTED FLUID SWIVEL

[75] Inventors: Karl A. B. Urdshals; Hans J. Hvide; Alan G. Hooper, all of Singapore, Singapore

[73] Assignee: Nortrans Shipping and Trading Far East Pte Ltd., Singapore

[21] Appl. No.: 925,916

[22] Filed: Aug. 7, 1992

[51] Int. Cl.[5] ..... B63B 21/52

[52] U.S. Cl. ..... 441/5; 441/4; 114/230; 166/350; 166/355

[58] Field of Search ..... 441/1-5; 114/230, 266, 267, 312, 326; 166/350-355, 367; 405/195, 224

[56] References Cited

U.S. PATENT DOCUMENTS

| | | | |
|---|---|---|---|
| 3,535,883 | 10/1970 | Manning . | |
| 3,614,869 | 10/1971 | Flory et al. . | |
| 3,700,014 | 10/1972 | Scales et al. | 114/230 |
| 3,760,875 | 9/1973 | Busking | 166/355 |
| 3,838,718 | 10/1974 | Flory | 441/5 |
| 4,031,582 | 6/1977 | Van Heijst . | |
| 4,042,990 | 8/1977 | Donaldson, Jr. | 114/230 |
| 4,069,529 | 1/1978 | Van Heijst | 114/230 |
| 4,138,751 | 2/1979 | Kentosh | 114/230 |
| 4,280,238 | 7/1981 | Van Heijst . | |
| 4,320,545 | 3/1982 | Pomonik | 441/4 |
| 4,326,312 | 4/1982 | Tang | 441/5 |
| 4,459,930 | 7/1984 | Flory | 114/230 |
| 4,546,721 | 10/1985 | Langrock | 114/230 |
| 4,602,586 | 7/1986 | Ortloff | 114/230 |
| 4,606,727 | 8/1986 | Koenig et al. | 441/5 |
| 4,637,335 | 1/1987 | Pollack | 114/230 |
| 4,637,336 | 1/1987 | Engelskirchen | 114/293 |
| 4,639,228 | 1/1987 | Bulow | 441/5 |
| 4,650,431 | 3/1987 | Kentosh | 441/5 |
| 4,654,015 | 3/1987 | Kentosh | 441/5 |
| 4,701,143 | 10/1987 | Key | 166/355 |
| 4,721,053 | 1/1988 | Brewerton | 114/230 |
| 4,765,378 | 8/1988 | Engelskirchen et al. | 114/230 |
| 4,798,155 | 1/1989 | Poldervaart | 114/230 |
| 4,802,431 | 2/1989 | Pollack | 114/230 |
| 4,838,823 | 6/1989 | De Baan et al. | 441/3 |
| 4,841,895 | 6/1989 | Brewerton | 114/230 |
| 4,892,495 | 1/1990 | Svensen | 441/5 |
| 4,917,038 | 4/1990 | Poldervaart et al. | 440/5 |
| 4,955,310 | 9/1990 | Pollack | 114/230 |
| 5,025,742 | 6/1991 | Urdshals | 114/230 |
| 5,041,038 | 8/1991 | Poldervaart et al. | 114/230 |
| 5,052,322 | 10/1991 | Poldervaart et al. | 114/230 |

*Primary Examiner*—Robert J. Oberleitner
*Assistant Examiner*—Clifford T. Bartz
*Attorney, Agent, or Firm*—Jones, Tullar & Cooper

[57] ABSTRACT

A mooring system for a seagoing vessel, such as an oil tanker, employs a submerged buoy and a fluid swivel joint mounted in the vessel. The buoy is submerged to a depth sufficient enough to allow the moored vessel to drift over the buoy and other mooring elements without colliding with the same. A motor drive assembly is provided for a rotating shaft in the fluid swivel joint which maintains the shaft in the same position relative to the buoy, regardless of environmental induced changes in the heading of the moored vessel. This insures that one or more flexible hoses connected between the shaft and the mooring will not be twisted if the vessel begins to rotate about the vertical axis of the mooring. Positioning the fluid swivel joint within the vessel provides easy access to the joint for maintenance or repair and shields the joint from the seawater's detrimental effects.

12 Claims, 5 Drawing Sheets

SINGLE POINT MOORING SYSTEM EMPLOYING A SUBMERGED BUOY AND A VESSEL MOUNTED FLUID SWIVEL

BACKGROUND OF THE INVENTION

The present invention relates in general to a single point mooring system for a sea going vessel, such as an oil tanker, which employs a submerged buoy in conjunction with a fluid swivel mounted on or within the vessel's hull to facilitate loading and unloading of the vessel's fluid contents.

Offshore mooring systems have long been employed to secure large seagoing vessels, such as oil tankers, to facilitate the loading and unloading thereof. These large vessels tend to have such deep drafts and generate such high mooring forces, that conventional harbors are frequently unable to accommodate them. Thus, systems for mooring these vessels at sea in relatively deep water have been developed wherein the fluid cargo can be transferred through underwater pipelines extending between the vessel and the shore facilities.

Numerous mooring systems have been developed to achieve this purpose, although most prior systems suffer from a number of drawbacks. For example, a number of prior art systems employ mooring elements which extend above the surface of the water and can be easily damaged in rough seas. Further, some means must be provided to prevent the moored vessel from drifting into the exposed elements of the mooring system. To allow a moored vessel to freely pivot about the mooring system, other prior art systems have employed complicated submerged fluid swivel joints which are undesirably exposed to the sea and cannot be accessed easily for maintenance or repair. In view of the foregoing, it is apparent that a new vessel mooring system is desirable which eliminates these drawbacks.

SUMMARY OF THE INVENTION

The present invention achieves this result by providing a completely submerged vessel mooring which employs no submerged fluid swivel joints. Instead, an easily accessible fluid swivel joint is contained within a moored vessel's hull that permits the vessel to freely "weathervane" about the mooring without twisting the mooring's fluid hoses or piping. Furthermore, the mooring is completely submerged to a depth below the loaded draft depth of the vessel so that in calm waters, the vessel can freely float over the mooring without colliding therewith.

The mooring comprises a submerged buoy which is connected via a pair of universal joints and a tendon to a base anchored on the seabed. The universal joints allow the tendon to pivot in any direction to allow for changes in the moored vessel's heading, and the buoy acts to hold the vessel on location by the restoring effect of the buoy's buoyancy.

On the top of the buoy is fitted a swivel connection for attachment to first ends of one or more vessel mooring lines, the second ends of which are attached to a suitable swivel connection installed at the forward or aft end of the vessel. A subsea pipeline is connected through numerous pipes or hoses associated with the mooring to the fluid swivel joint contained within the moored vessel.

Since the hose connecting the vessel to the mooring cannot rotate relative to the mooring, the fluid swivel in the vessel must counteract any twisting action on the hose as the vessel rotates about the mooring due to environmental effects. To accomplish this, a motor drive assembly is provided on the swivel joint which insures that the joint maintains the proper alignment with the mooring, regardless of the heading of the vessel.

BRIEF DESCRIPTION OF THE DRAWINGS

The foregoing and other features and advantages of the present invention will become apparent from the following detailed description of a preferred embodiment thereof, taken in conjunction with the accompanying drawings in which.

DETAILED DESCRIPTION OF THE PREFERRED EMBODIMENT

Figure 1:
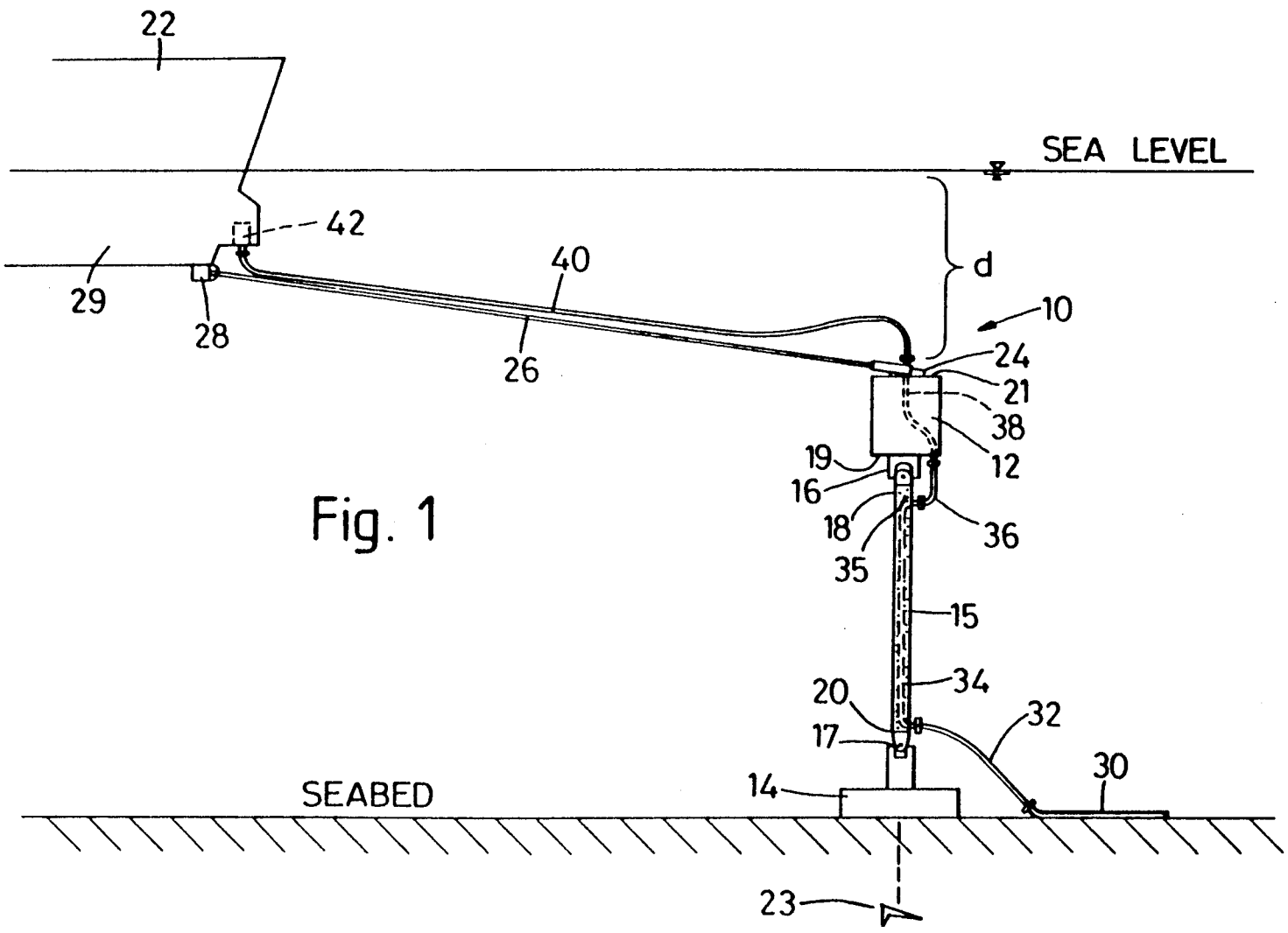
FIG. 1 is a schematic illustration of a mooring system which forms a preferred embodiment of the present invention.

Turning now to a more detailed consideration of a preferred embodiment of the present invention, FIG. 1 illustrates a mooring 10 including a buoy 12 which is completely submerged in a body of water, such as the sea, and is secured to a base 14 by means of an elongated tendon member 15 and a pair of universal joints 16 and 17, respectively. More particularly, the first universal joint 16 connects a top end 18 of the tendon member 15 to a bottom 19 of the buoy 12, while the second universal joint 17 connects a bottom end 20 of the tendon member 15 to the base 14.

A top 21 of the buoy 12 is submerged below the water's surface by a depth d which, as discussed in greater detail below, is greater than the maximum loaded draft depth of a floating vessel 22 to be moored. This insures that the vessel 22 can pass over the buoy 12 and other elements of the mooring 10 without colliding therewith. The buoy 12 can be of any conventional design such as a ballastable, sealed or pressurized type made of any material, shape or size suitable for the conditions to which it will be exposed. The base 14 is held in place on the seabed either by suitable weights, or by one or more anchors 23.

Fitted to the top 21 of the buoy 12 is a swivel connection 24 to which first ends of one or more mooring lines 26 are attached. The mooring lines 26 can be made of wire, chain, rope or any other rigid member. The swivel connection 24 permits full 360° rotation of the mooring lines 26 so that the vessel 22 can "weathervane" about the vertical axis of the buoy 12 in response to variable wind and current conditions.

The opposite, second ends of the mooring lines 26 are attached to a suitable swivel connection 28 installed on a hull 29 of the vessel 22 at either the forward or aft end thereof. Preferably, the swivel connection 28 is situated low on the hull 29 in order to reduce the vertical uplift on the buoy 12 in cases where the mooring lines 26 are kept short. The swivel connection 28 allows for free movement of the mooring lines 26 to any position under the vessel 22, and three different embodiments of the mooring connection 28 are illustrated in FIGS. 2A–C.

Figure 2A:
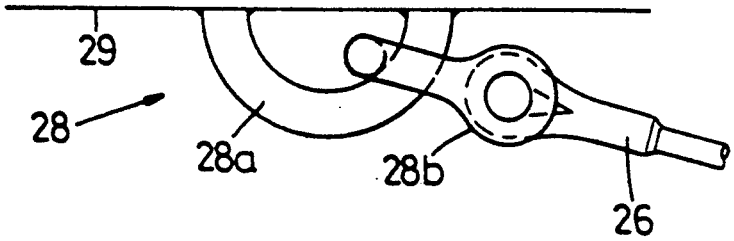
FIGS. 2A–C are illustrations of three different types of mooring line connections which can be employed with the system of FIG. 1.
Figure 2B:
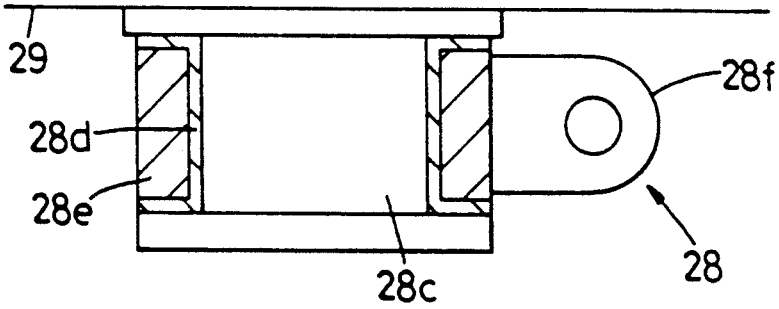
Figure 2C:
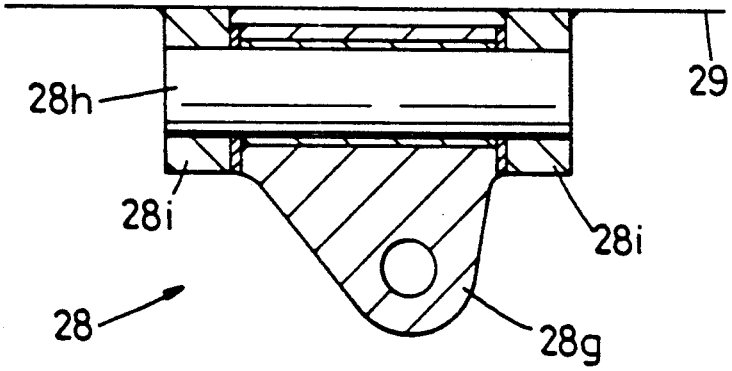

In its simplest form as illustrated in FIG. 2A, the connection 28 is a simple "eye" type including an eye 28*a* attached to the bottom of the hull 29 and a shackle 28*b* connecting the eye 28*a* to the one or more mooring lines 26. Alternatively, as illustrated in FIGS. 2B and C, pivoting eye plates can be employed. In particular, the connection 28 illustrated in FIG. 2B employs a collared shaft 28*c* attached to the bottom of the vessel hull 29 having a bushing 28*d* and a rotating ring 28*e* disposed thereon. The ring 28*e* has an eye plate extension 28*f* for connecting to the one or more mooring lines 26 and is rotatable about the vertical axis of the shaft 28*c*. The embodiment of the connection 28 illustrated in FIG. 2C is similar to that illustrated in FIG. 2B, however, a pivoting eye plate 28*g* is rotatably mounted on a horizontally disposed pin 28*h* attached to the bottom of the vessel hull 29 by means of a pair of mounting brackets 28*i*.

Returning to FIG. 1, a fluid handling assembly comprising numerous fluid hoses or pipes is attached to the mooring 10 which enables fluid storage compartments in the vessel 22 to be communicated with an underwater pipeline 30 for loading or unloading the vessel 22. In particular, a first flexible hose or pipe 32 is connected between the underwater pipe 30 and a second pipe 34 attached to, or contained within a hollow core 35 of, the tendon 15. The hose 32 is made flexible to accommodate pivoting movement of the tendon 15 relative to the fixed base 14. A third flexible pipe or hose 36 connects the second pipe 34 to a fourth pipe 38 mounted externally or internally of the buoy 12. At the top 21 of the buoy 12, the fourth pipe 38 passes through the center of the swivel connection 24 and is connected to a fifth, flexible hose or pipe 40, which in turn is removably connectable to a fluid swivel joint assembly 42 contained within the vessel hull 29.

As discussed previously, the top 21 of the buoy 12 is submerged below the water's surface by depth d which is great enough to allow a loaded vessel to pass over the buoy 12 and other elements of the mooring 10 without colliding therewith. More particularly, the depth d is chosen to be equal to or greater than the maximum loaded draft depth of the vessel 22 to be moored (typically 15–25 meters) plus eight (8) times the diameter of the flexible hose 40. The latter measurement is to insure that as the vessel 22 passes over the mooring 10 and the flexible hose 40 folds over itself, the flexible hose 40 will neither become kinked nor crimped between the vessel 22 and the buoy 12. Thus, if the vessel 22 has a loaded draft depth of 15 meters and the hose 40 has a diameter of 0.5 meters one foot, then the top 21 of the buoy 12 should be submerged at least $15+8(0.5)=19$ meters beneath the water's surface. It should be noted that this measurement represents the minimum depth at which the buoy 12 should be submerged, however, in actual practice, the buoy 12 would most likely be submerged considerably deeper than this minimum depth.

Figure 3:
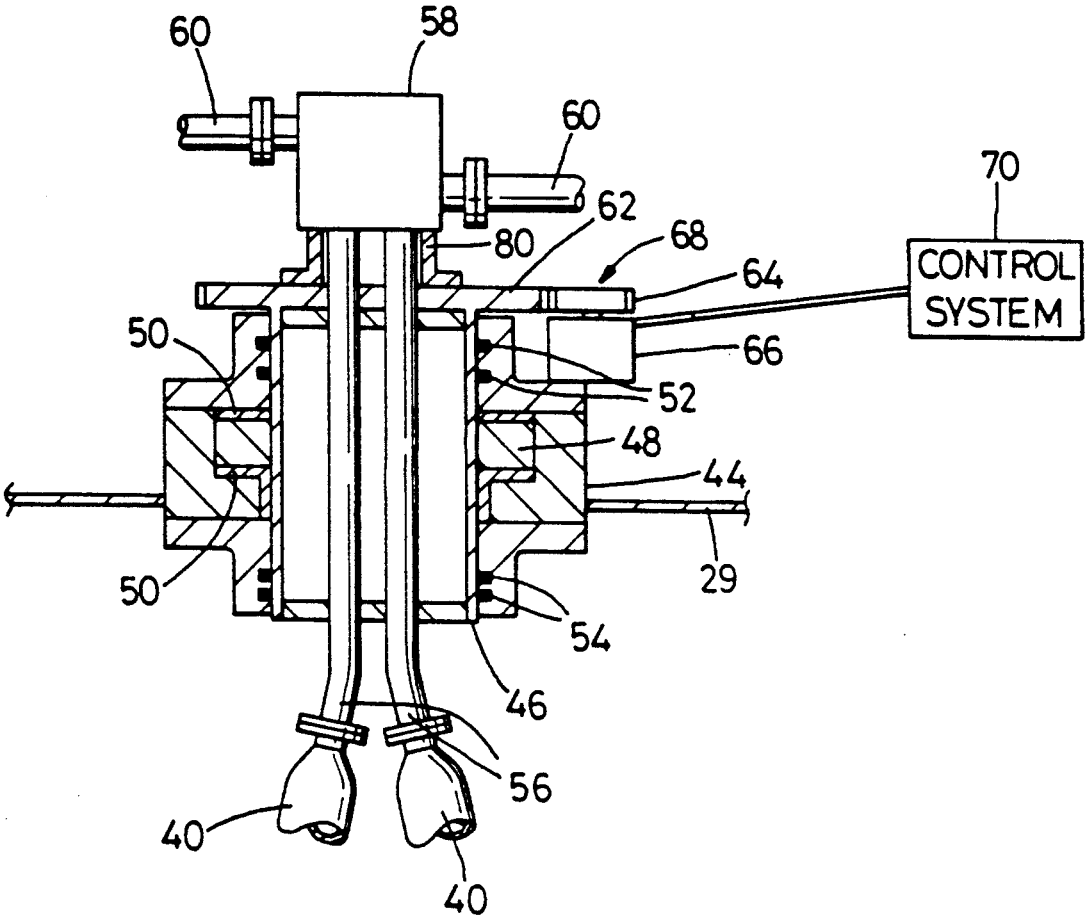
FIG. 3 is a partially sectional side view of a fluid swivel joint assembly employed with the system of FIG. 1.

Turning now to FIG. 3, the details of a preferred embodiment of the fluid swivel joint assembly 42 are illustrated. In this embodiment, two of the flexible hoses 40 are employed, although it will be understood that any number of the hoses can be employed as desired without changing the basic design and function of the swivel joint assembly 42. As illustrated, the fluid swivel joint assembly 42 includes a main body 44 which is secured to the vessel hull 29 by welding, bolting or other suitable conventional means. Disposed within the main body 44, is a hollow, rotatable shaft 46 having an external thrust collar 48 which rides between two sets of thrust bearings 50 that align the shaft 46 in the main body 44, and allow it to rotate about a vertical axis. An upper seal assembly 52 and a lower seal assembly 54 are also provided between the main body 44 and the rotatable shaft 46 which prevent seawater from entering either the vessel hull 29 or the bearings 50, and also insure retention of oil, grease or similar lubricant in the bearings 50.

Contained within the hollow rotatable shaft 46 are a pair of fluid pipes 56 which are connected at their bottom ends to a respective one of the flexible hoses 40, and at their top ends to a fluid swivel joint 58 mounted at the top end of the shaft 46. The details of the fluid swivel joint 58 are discussed in greater detail below in conjunction with FIG. 5. A pair of fixed, shipboard pipes 60 are connected to the fluid swivel joint 58 for directing fluid between it and storage compartments in the vessel 22. Since the fluid swivel joint 58 and other components of the fluid swivel joint assembly 42 are not exposed to seawater, but instead are mounted within or on the vessel 22, they are less vulnerable to damage and leakage, and can be easily accessed for maintenance or repairs.

Attached to the upper end of the rotatable shaft 46 is a drive gear 62 which engages a pinion gear 64 that in turn is mounted on the output shaft of a motor 66. These three elements form a drive assembly 68 for the rotatable shaft 46 which is employed to rotate the shaft 46 relative to the vessel 22. This is employed to avoid twisting of the fluid hose or hoses 40 as the vessel rotates freely about the mooring system 10 in response to changing currents or wind, and is necessary because the flexible hoses 40 do not impart enough force on the bearings 50 to cause rotation of the shaft 46 before the hoses have already twisted enough to cause potential damage thereto.

Figure 4:
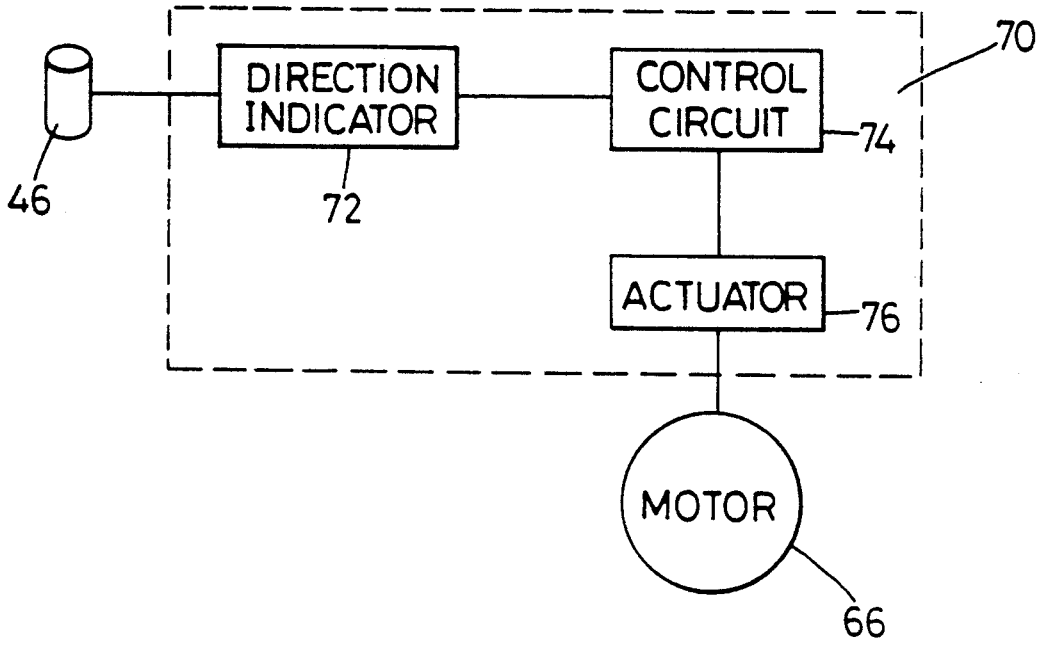
FIG. 4 is a schematic block diagram of a control system for a motor for the fluid swivel joint assembly of FIG. 3; and, FIG. 5 is a cross sectional side view of a fluid swivel joint which forms a part of the joint assembly of FIG. 3.

Preferably, the motor 66 is an electric, air or hydraulic type that is controlled by a control system 70 which detects the heading of the rotatable shaft 46 in much the same way as does an automatic steering or autopilot system, and generates motor control signals in response to the detected heading. The control system 70 is illustrated in greater detail in FIG. 4 and includes a direction indicator 72 which senses the direction or heading of the rotatable shaft 46 relative to the mooring 10. The direction indicator 72 can be of conventional construction, such as a gyro or compass, and generates heading responsive electrical signals that are fed to a motor or pump control circuit 74. The motor or pump control circuit 74 analyzes the signals from the direction indicator 72 and generates appropriate control signals for a motor or pump actuator 76 which actuates the electric, air or hydraulic motor 66 as needed to maintain the heading of the rotatable shaft 46 constant with respect to the mooring 10, irrespective of heading changes in the vessel 22. In this manner, as the vessel 22 "weathervanes" about the mooring 10, the fluid swivel joint 58 will automatically compensate for this movement and prevent any twisting of the one or more flexible hoses 40.

Figure 5:
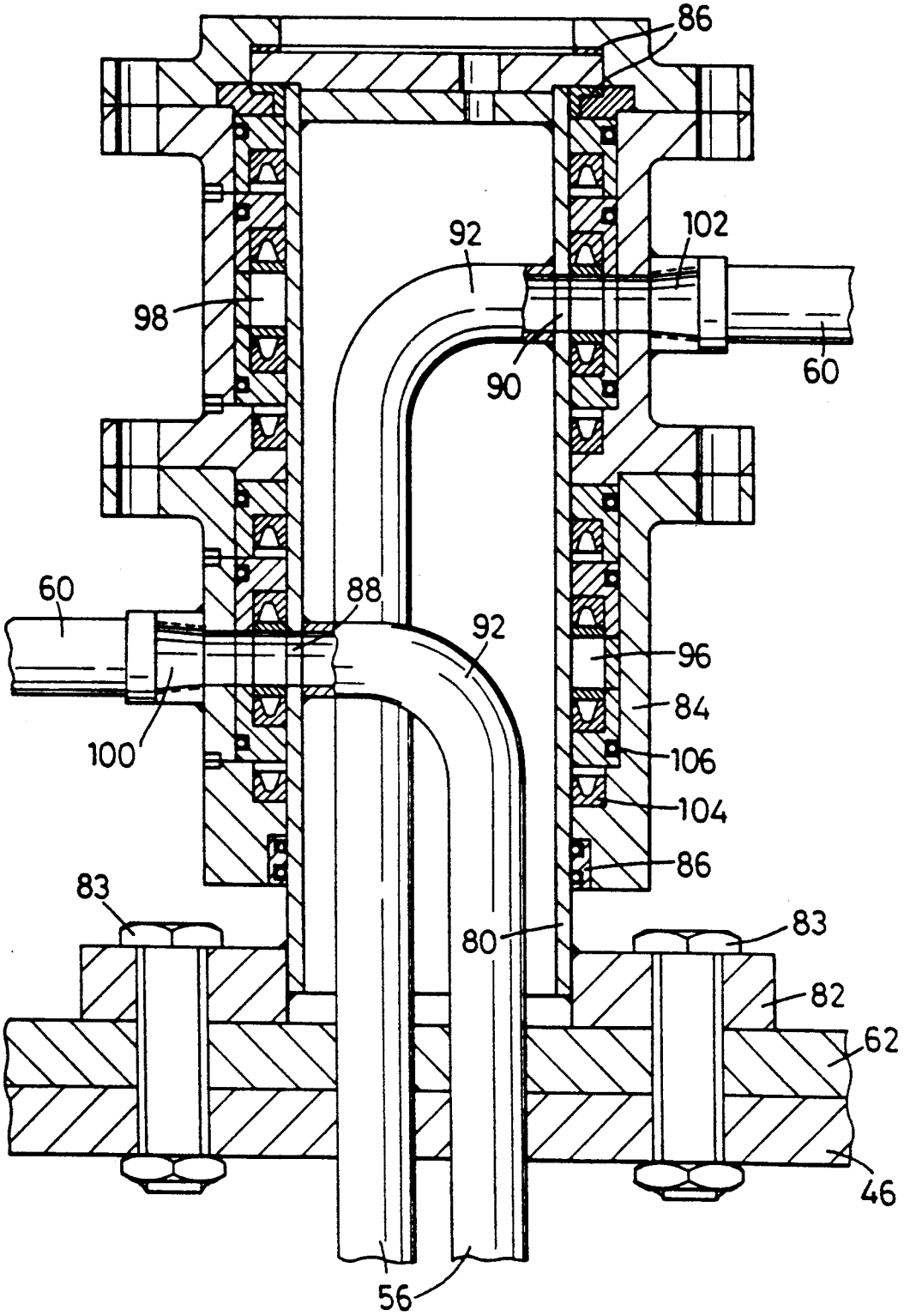

Turning now to FIG. 5, the details of the fluid swivel joint 58 are illustrated. In particular, the fluid swivel joint 58 includes a rotatable shaft 80 which is connected to the rotatable shaft 46 and drive gear 62 by means of a flange 82 and a plurality of nut and bolt assemblies 83, or any other suitable fastening means. The shaft 80 is rotatable within a fixed body 84 and a plurality of bearing assemblies 86 are employed between these two elements to permit this relative rotation. First and second fluid ports 88 and 90 are provided in the shaft 80 to which are each attached, a respective curved top end 22 of one of the fluid pipes 56. First and second circumferential outlet rings 96 and 98 are disposed within the body 84 which communicate with the ports 88 and 90, respectively, as the shaft 80 rotates. These outlet rings 96 and 98 are connected to first and second outlet ports 100 and 102, respectively, which in turn are connected to the shipboard pipes 60. A plurality of fluid pressure seals 104 and O-rings 106 are provided to seal the various elements of the fluid swivel joint 58.

In the operation of the mooring system, when the vessel 22 is connected to the mooring 10 via the one or more mooring lines 26, the buoyancy of the buoy 12 will urge the tendon 15 into a vertical position and thereby maintain the position of the vessel 22 relative to the buoy 12. If a strong current or wind pushes the vessel 22 away from the buoy 12, the tendon 16 will pivot downwardly about the pivoting axis of the lower universal joint 17, thereby forcing the buoy 12 to sink closer to the seabed. The buoyancy effect of the buoy 12 will thereby increase to counteract the forces acting on the vessel 22. Once these forces subside, the buoy 12 will urge the tendon 15 back into its original vertical position.

In calm waters, the vessel 22 may begin to drift toward the buoy 12. In prior art mooring systems where a portion of the mooring extends above the sea's surface, some means must be provided in this situation to prevent the vessel from running into the mooring. This is unnecessary, however, with the present system in which the entire mooring 10 is submerged to a depth which will allow the vessel 22 to pass over the mooring 10 without colliding therewith. The fact that the entire mooring 10 is completely submerged also eliminates or substantially reduces the likelihood of weather or wave induced damage.

Although the present invention has been described in terms of a preferred embodiment, it will be understood that numerous modifications and variations could be made thereto without departing from the spirit and scope of the invention as set forth in the following claims.

What is claimed is:

1. A mooring system for mooring a floating vessel in a body of water comprising:

a) a buoy completely submerged in said body of water and having a top and a bottom; wherein said top of said buoy is submerged to a depth greater than a loaded draft depth of the vessel to be moored and wherein the vessel can drift directly over said buoy without colliding therewith;

b) an elongated member having a top and a bottom end;

c) a base secured to a bed of said body of water;

d) a first universal joint connecting said bottom of said buoy to said to end of said elongated member;

e) a second universal joint connecting said bottom end of said elongated member to said base;

f) at least a first mooring line connected at one end to said buoy and connectable at a second end to a vessel to be moored;

g) first fluid handling means connected to said buoy;

h) at least a first flexible hose connected at a first end to said fluid handling means and connected at a first end to a vessel to be moored.

2. The mooring system of claim 1, further comprising a fluid swivel joint assembly disposed within a hull of said floating vessel to be moored, said assembly including:

a body fixed to said vessel having a first fluid port connected to second fluid handling means disposed on said vessel;

a rotatable shaft disposed within said body and having a second fluid port connected to said second end of said first flexible hose; and, means to communicate said first and second ports, whereby fluid can be transferred between said second fluid handling means and said flexible hose.

3. The mooring system of claim 2, further including a drive assembly connected to said rotatable shaft for maintaining said shaft in the same position relative to said buoy, regardless of changes in said vessel's heading.

4. The mooring system of claim 3, further including a control system for said drive assembly including means to sense the heading of said rotatable shaft and generate control signals for said drive assembly in response to the sensed heading which will maintain the shaft's heading constant.

5. A mooring system submerged in a body of water, for mooring a floating vessel, comprising:

a) a buoy completely submerged in said body of water and having a top and a bottom; wherein said top of said buoy is submerged to a depth greater than a loaded draft depth of the vessel to be moored and wherein the vessel can drift directly over said buoy without colliding therewith;

b) an elongated member having a top and a bottom end;

c) a base secured to a bed of said body of water;

d) a first universal joint connecting said bottom of said buoy to said to end of said elongated member;

e) a second universal joint connecting said bottom end of said elongated member to said base;

f) a first mooring line having a first end and a second end, said first end connected to said buoy, and said second end connectable to the vessel to be moored;

g) a completely submerged fluid handling means having a top end connected to said buoy and submerged below the draft depth of the vessel to be moored, and a bottom end connectable to a submerged pipeline; and h) a first flexible hose having a first end and a second end, said first end connected to said top of said completely submerged fluid handling means, and said second end connectable to the vessel to be moored.

6. The mooring system of claim 5, further comprising a fluid swivel joint assembly disposed within a hull of said floating vessel to be moored, said assembly including:

a body fixed to said vessel having a first fluid port connected to second fluid handling means disposed on said vessel;

a rotatable shaft disposed within said body and having a second fluid port connected to said second end of said first flexible hose; and means to communicate said first and second ports, whereby fluid can be transferred between said second fluid handling means and said flexible hose.

7. The mooring system of claim 6, further including a drive assembly connected to said rotatable shaft for maintaining said shaft in the same position relative to said buoy, regardless of changes in said vessel's heading.

8. The mooring system of claim 7, further including a control system for said drive assembly including means to sense the heading of said rotatable shaft and generate control signals for said drive assembly in response to the sensed heading which will maintain the shaft's heading constant.

9. A submerged mooring system for mooring a floating vessel, having a draft depth, in a body of water, comprising:

a) a buoy completely submerged in said body of water and having a top and a bottom, and a line swivel;

b) an elongated member having a top and a bottom end separated from said top end by a first chosen length;

c) a base secured to a bed of said body of water;

d) a first universal joint connecting said bottom of said buoy to said to end of said elongated member;

e) a second universal joint connecting said bottom end of said elongated member to said base;

f) said first chosen length of said elongated member being sufficient to submerge said buoy to a depth greater than the draft depth of the vessel, whereby the vessel can drift directly over said buoy without colliding therewith;

g) a first mooring line having a first end and a second end separated by a second chosen length, said first end connected to said buoy line swivel, and said second end connectable to the vessel;

h) said second chosen length being greater than the vessel draft depth, whereby the vessel can drift directly over said buoy without colliding therewith;

i) first fluid handling means connected to said buoy;

j) a first flexible hose having a first end and a second end separated by a third chosen length, said first end connected to said fluid handling means, and said second end connectable to the vessel; and k) said third chosen length being greater than the vessel draft depth and equal to or greater than the second chosen length, whereby the vessel can drift directly over said buoy without colliding therewith.

10. The mooring system of claim 9, further comprising a fluid swivel joint assembly disposed within a hull of said floating vessel to be moored, said assembly including:

a body fixed to said vessel having a first fluid port connected to second fluid handling means disposed on said vessel;

a rotatable shaft disposed within said body and having a second fluid port connected to said second end of said first flexible hose; and means to communicate said first and second ports, whereby fluid can be transferred between said second fluid handling means and said flexible hose.

11. The mooring system of claim 10, further including a drive assembly connected to said rotatable shaft for maintaining said shaft in the same position relative to said buoy, regardless of changes in said vessel's heading.

12. The mooring system of claim 11, further including a control system for said drive assembly including means to sense the heading of said rotatable shaft and generate control signals for said drive assembly in response to the sensed heading which will maintain the shaft's heading constant.

* * * * *